US012631327B2

(12) United States Patent
Pan et al.

(10) Patent No.: US 12,631,327 B2
(45) Date of Patent: May 19, 2026

(54) GAS COOKTOP AND EJECTOR TUBE THEREOF

(71) Applicant: BSH Hausgeräte GmbH, Munich (DE)

(72) Inventors: Shuo Pan, Nanjing (CN); Jianxiang Ma, Nanjing (CN); Haitao Luo, Nanjing (CN)

(73) Assignee: BSH Hausgeräte GmbH, Munich (DE)

( * ) Notice: Subject to any disclaimer, the term of this patent is extended or adjusted under 35 U.S.C. 154(b) by 389 days.

(21) Appl. No.: 18/032,363

(22) PCT Filed: Oct. 6, 2021

(86) PCT No.: PCT/EP2021/077533
§ 371 (c)(1),
(2) Date: Apr. 18, 2023

(87) PCT Pub. No.: WO2022/084037
PCT Pub. Date: Apr. 28, 2022

(65) Prior Publication Data
US 2023/0383946 A1 Nov. 30, 2023

(30) Foreign Application Priority Data
Oct. 21, 2020 (CN) ..... 202022360863.3

(51) Int. Cl.
*F23D 14/64* (2006.01)
*F24C 3/08* (2006.01)

(52) U.S. Cl.
CPC ..... *F23D 14/64* (2013.01); *F24C 3/085* (2013.01); *F23D 2203/007* (2013.01)

(58) Field of Classification Search
CPC .... F23D 14/64; F23D 2203/007; F24C 3/085; B01F 25/10; B01F 23/10
USPC ..... 126/39 R; 137/888
See application file for complete search history.

(56) References Cited

U.S. PATENT DOCUMENTS 2,253,834 A * 8/1941 Volks ..... A47J 37/0682 126/214 R
2004/0231586 A1 11/2004 Dugue
2010/0193608 A1* 8/2010 Liou ..... F23D 14/64 239/589
2018/0274781 A1 9/2018 Usci

FOREIGN PATENT DOCUMENTS

CN 104566374 A 4/2015
KR 200363754 Y1 10/2004

OTHER PUBLICATIONS

International Search Report PCT/EP2021/077533 dated Jan. 12, 2022.

* cited by examiner

*Primary Examiner* — Vivek K Shirsat
(74) *Attorney, Agent, or Firm* — Michael E. Tschupp; Andre Pallapies; Brandon G. Braun

(57) ABSTRACT

An ejector tube of a gas cooktop and a gas cooktop. An embodiment of this application relates to an ejector tube of a gas cooktop, including a tube body provided with a gas inlet and a gas outlet, where a plurality of air filling through holes are provided around a wall body of the tube body, thereby helping to improve a mixing effect of gas and primary air.

17 Claims, 1 Drawing Sheet

GAS COOKTOP AND EJECTOR TUBE THEREOF

CROSS-REFERENCES TO RELATED APPLICATIONS

This application is the U.S. National Stage of International Application No. PCT/EP2021/077533, filed Oct. 6, 2021, which designated the United States and has been published as International Publication No. WO 2022/084037 A1 and which claims the priority of Chinese Patent Application, Serial No. 2020/22360863.3, filed Oct. 21, 2020, pursuant to 35 U.S.C. 119(a)-(d).

The contents of International Application No. PCT/EP2021/077533 and Chinese Patent Application, Serial No. 2020/22360863.3 are incorporated herein by reference in their entireties as if fully set forth herein.

TECHNICAL FIELD

This application relates to the field of gas cooktops, and in particular, to an ejector tube of a gas cooktop.

BACKGROUND OF THE INVENTION

A gas cooktop is an important household appliance that is indispensable in home life. In Asia, because of the traditional cooking habit of stir-frying, requirements for combustion efficiency are particularly high. An ejector tube is disposed on a gas cooktop to mix gas and primary air. A mixing effect of the gas and the primary air directly affects the combustion efficiency of the gas cooktop. Based on the feedback from a large number of users, in actual use, flame on the gas cooktop is not ideal, in many cases, due to a poor mixing effect of the gas and the primary air, and needs to be improved urgently.

Unless supported by sufficient evidence, the prior art described herein do not mean acknowledging that the prior art is known to a person of ordinary skill in the field of this application before the filing date of this application.

BRIEF SUMMARY OF THE INVENTION

An objective of embodiments of this application is to provide an improved ejector tube of a gas cooktop and a gas cooktop to resolve at least one of the foregoing problems.

An embodiment of this application relates to an ejector tube of a gas cooktop, including a tube body provided with a gas inlet and a gas outlet, where a plurality of air filling through holes are provided around a wall body of the tube body, thereby helping to improve a mixing effect of gas and primary air.

In a possible design, the plurality of air filling through holes are configured to be adapted to filling, under the action of a gas flow that flows in from the gas inlet, primary air to the gas flow, and the gas flow is driven by the primary air to rotate, thereby helping to improve a mixing effect of gas and primary air.

In a possible design, the air filling through hole extends along a straight-line direction from an air inlet orifice in an outer wall of the tube body toward an air outlet orifice in an inner wall of the tube body, and the extending direction deviates toward the gas outlet in the gas inlet and the gas outlet.

In a possible design, the extending directions of the plurality of air filling through holes all deviate from a centerline X of the tube body, thereby helping the primary air that flows in from the air filling through holes tend to rotate along a circumferential direction of the tube body, to drive the gas flow to rotate.

In a possible design, air inlet orifices of the plurality of air filling through holes are sequentially arranged evenly spaced along a circumferential direction of the outer wall of the tube body; and air outlet orifices of the plurality of air filling through holes are sequentially arranged evenly spaced along a circumferential direction of the inner wall of the tube body.

In a possible design, a distance between the air inlet orifice and the gas inlet is less than one third of a length L of the tube body, thereby helping to improve a mixing effect of gas and primary air.

In a possible design, a frustum-shaped flow-guiding face is provided at an inner wall of the gas inlet of the tube body; and the gas flow that flows in from the gas inlet flows through the frustum-shaped flow-guiding face and then flows through the air outlet orifice.

In a possible design, there are two to ten air filling through holes, arranged evenly spaced around the tube body.

Another embodiment of this application relates to a gas cooktop, including a burner, a nozzle, and the ejector tube according to any one of the foregoing aspects, where the ejector tube is configured to be adapted to mixing a gas flow entering from the nozzle with primary air and then delivering the mixture to the burner.

In a possible design, a spacing between the nozzle and the gas inlet of the ejector tube is set to be adjustable.

Content of the foregoing technical solutions of this application is not intended to describe all possible implementations of this application. Throughout this application, guidance is provided in many places by listing examples, and the examples may be used in various feasible combinations.

BRIEF DESCRIPTION OF THE DRAWINGS

The following accompanying drawings are only used to exemplarily illustrate and explain this application, and are not intended to limit scope of this application.

REFERENCE SIGNS

1—air filling through hole, 2—gas inlet, 3—gas outlet, 4—outer wall of tube body, 5—inner wall of tube body, 6—frustum-shaped flow-guiding face, 7—fixing groove.

DETAILED DESCRIPTION

To make the objectives, solutions, and beneficial effects of this application clearer, the following further describes this application with reference to the accompanying drawings and preferred embodiments.

This application provides an embodiment of a gas cooktop, including a burner, a nozzle, and an ejector tube. The ejector tube is configured to be adapted to mixing a gas flow entering from the nozzle with primary air and then delivering the mixture to the burner, as schematically shown in FIG. 2.

Figure 1:
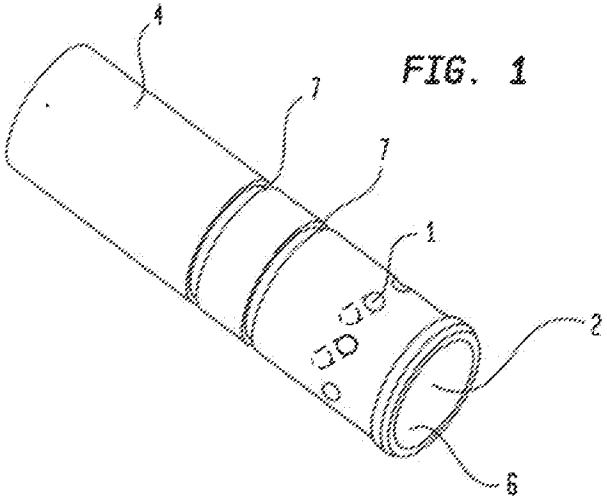
FIG. 1 is a schematic diagram of a structure of an ejector tube of an embodiment of a gas cooktop according to this application.
Figure 2:
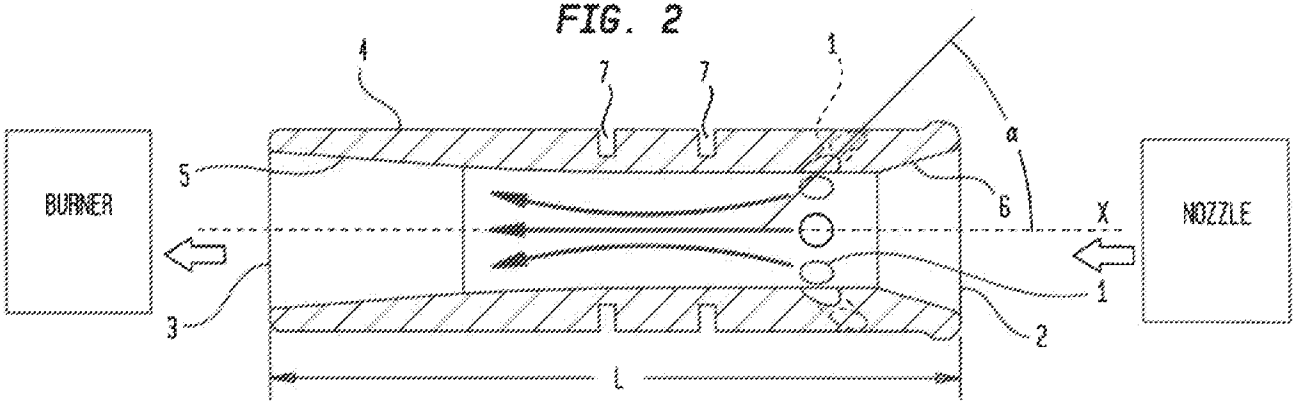
FIG. 2 is a cross-sectional view of the structure shown in FIG. 1.

The ejector tube includes a tube body provided with a gas inlet 2 and a gas outlet 3, as shown in FIG. 1 and FIG. 2. The ejector tube is a venturi tube. The tube body of the ejector tube is cylindrical as a whole. The nozzle is configured to be adapted to jetting a high-speed gas flow to the gas inlet 2.

An outer wall 4 of the tube body of the ejector tube is provided with two rings of fixing grooves 7 to fix the ejector tube and the burner. For a specific fixing method, refer to the Applicant's another Chinese Patent Application CN201310130504.0, where a plurality of air filling through holes 1 are provided around a wall body of the tube body of the ejector tube. Specifically, there are eight air filling through holes 1 that are arranged evenly spaced around the tube body, as shown in FIG. 1 and FIG. 2.

The eight air filling through holes 1 are configured to be adapted to filling, under the action of negative pressure generated by a gas flow that flows in from the gas inlet 2, primary air to the gas flow. The gas flow is driven by the primary air that flows in from the air filling through holes 1 to rotate because the primary air that flows in from the air filling through holes 1 tends to rotate as a whole along a circumferential direction of the tube body. In this way, after being mixed, the gas flow and the primary air rotate forward like a vortex, which helps to improve a mixing effect of the gas and the primary air, thereby improving combustion efficiency. Specifically, in addition to an axial velocity component and a radial velocity component, the vortex-like rotating forward motion also has a tangential velocity component and characteristics of rotating turbulent motion and circumfluence, which greatly improves a degree of the mixing of the gas and the primary air and enhances flame stability and combustion intensity, thereby improving combustion efficiency and reducing flue gas.

The air filling through holes 1 are provided, to not only improve the mixing effect of the gas and the primary air, but also make it possible to shorten a distance between the nozzle and the ejector tube, which helps to reduce the occupied space, thereby decreasing volumes of related components of the gas cooktop and reducing costs.

The air filling through holes 1 are formed by drilling holes along an inclined direction on the outer wall 4 of the tube body. The "inclined direction" means that the drilling direction is inclined relative to the radial direction of the tube body. The air filling through holes 1 all extend along a straight-line direction from an air inlet orifice in an outer wall 4 of the tube body toward an air outlet orifice in an inner wall 5 of the tube body. The extending direction is not radial, but deviates toward the gas outlet 3 in the gas inlet 2 and the gas outlet 3.

The air filling through holes 1 are independent of each other and are arranged evenly spaced around the tube body without a cross-connection point.

The extending directions of the eight air filling through holes 1 all deviate from a centerline X of the tube body, that is, none of the extending directions of the eight air filling through holes 1 intersects the centerline X of the tube body. The centerline X of the tube body is shown in FIG. 2. The so-called "the centerline X of the tube body" may be understood as a line formed by centers of cross sections of the tube body. Air inlet orifices of the eight air filling through holes 1 are sequentially arranged evenly spaced along a circumferential direction of the outer wall 4 of the tube body, as shown in FIG. 1. Air outlet orifices of the eight air filling through holes 1 are sequentially arranged evenly spaced along a circumferential direction of the inner wall 5 of the tube body, as shown in FIG. 2. Obviously, the extending directions of the air filling through holes 1 are consistent in the circumferential direction of the tube body, thereby helping the primary air that flows in from the air filling through holes 1 tend to rotate along the circumferential direction of the tube body as a whole. A deviation angle $\alpha$ of the extending direction of each air filling through hole 1 relative to the centerline X of the tube body is 45 degrees, as shown in FIG. 2. A deviation angle $\beta$ of the extending direction of each air filling through hole 1 relative to the radial direction of the tube body is 45 degrees.

A distance between the air inlet orifice and the gas inlet 2 is less than a distance between the air outlet orifice and the gas inlet 2.

The distance between the air inlet orifice and the gas inlet 2 is less than one third of a length L of the tube body of the ejector tube. The length L of the tube body of the ejector tube is shown in FIG. 2.

A frustum-shaped flow-guiding face 6 is provided at an inner wall of the gas inlet 2 of the tube body as shown in FIG. 1 and FIG. 2. The gas flow that flows in from the gas inlet 2 flows through the frustum-shaped flow-guiding face 6 and then flows through the air outlet orifice. A flow direction of the gas flow is shown by an arrow in FIG. 2. The inner diameter of the frustum-shaped flow-guiding face 6 gradually decreases along the flow direction of the gas flow.

The gas inlet 2 of the tube body is further provided with an air damper. Another part of the primary air passes through the air damper and flows into the tube body of the ejector tube to mix with the gas.

Figure 3:
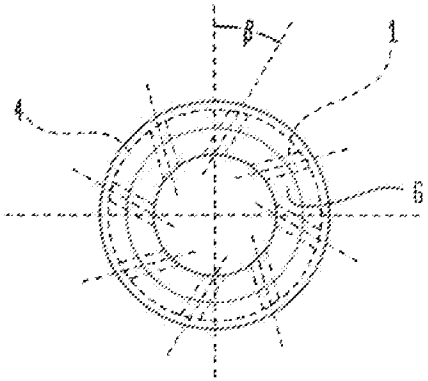
FIG. 3 is a right-side view of FIG. 1.

The above is only one embodiment of this application, and other embodiments may be obtained by adding, deleting, modifying, or replacing some technical features. For example, alternatively, a spacing between the nozzle and the gas inlet of the ejector tube is set to be adjustable. During long-term use of the gas cooktop, the air filling through holes may be blocked. In this case, adjusting the spacing between the nozzle and the gas inlet of the ejector tube helps to improve a mixing effect of gas and primary air according to an actual status. In another example, the deviation angle $\alpha$ of the extending direction of each air filling through hole relative to the centerline X of the tube body may alternatively be another angle greater than or equal to 20 degrees and less than or equal to 80 degrees. In still another example and shown by way of example in FIG. 3, the deviation angle $\beta$ of the extending direction of each air filling through hole relative to the radial direction of the tube body may alternatively be another angle greater than or equal to 20 degrees and less than or equal to 80 degrees.

Components of different embodiments may be combined with each other in any feasible manner to achieve objectives of this application.

What needs to additionally note is that this application should not be understood as being limited to the foregoing described implementations, but should be understood as covering all possible implementation conditions determined by claims of this application in combination with the disclosure of the specification. Therefore, any simple amendment, equivalent change and modification made to the foregoing embodiment based on the technical essence of the application without departing from the content of the application should fall within the protection scope of this application.

What is claimed is:

1. An ejector tube of a gas cooktop, said ejector tube comprising:

a tube body including:

a gas inlet, a gas outlet, and a wall body having a plurality of air filling through holes provided around the wall body of the tube body, wherein each of the air filling through holes of the plurality of air filling through holes is configured to extend along a straight-line direction from an air inlet orifice in an outer wall of the tube body toward an air outlet orifice in an inner wall of the tube body, and an extending direction of each of the air filling through holes of the plurality of air filling through holes deviates toward the gas outlet in the gas inlet and the gas outlet, wherein the inner wall of the tube body at the gas inlet has a frustum-shaped flow-guiding face between the gas inlet and the air outlet orifice of each of the plurality of air filling through holes, wherein the frustum-shaped flow-guiding face gradually decreases from the gas inlet to a portion of the inner wall of the tube body, and wherein the portion of the inner wall of the tube body is upstream of the air outlet orifice of each of the plurality of air filling through holes, such that the gas flow that flows in from the gas inlet flows through the frustum-shaped flow-guiding face, through the portion of the inner wall of the tube body having the air outlet orifice of each of the plurality of air filling through holes, and through the air outlet orifice.

2. The ejector tube of claim 1, wherein, as a gas flow flows in from the gas inlet, the plurality of air filling through holes are configured to mix primary air to the gas flow such that the gas flow is caused by the primary air to rotate.

3. The ejector tube of claim 1, wherein the extending directions of the plurality of air filling through holes all deviate from a centerline X of the tube body.

4. The ejector tube of claim 3, wherein air inlet orifices of the plurality of air filling through holes are sequentially arranged evenly spaced along a circumferential direction of the outer wall of the tube body, and wherein air outlet orifices of the plurality of air filling through holes are sequentially arranged evenly spaced along a circumferential direction of the inner wall of the tube body.

5. The ejector tube of claim 1, wherein a distance between the air inlet orifice and the gas inlet is less than one third of a length of the tube body.

6. The ejector tube of claim 1, wherein the plurality of air filling through holes includes two to ten air filling through holes which are arranged evenly spaced around the tube body.

7. A gas cooktop, comprising:

a burner;

a nozzle; and an ejector tube configured to mix a gas flow entering from the nozzle with primary air and then delivering the mixture to the burner, said ejector tube comprising:

a tube body including a gas inlet communicating with the nozzle, a gas outlet, and a wall body having a plurality of air filling through holes provided around the wall body of the tube body, wherein each of the air filling through holes of the plurality of air filling through holes is configured to extend along a straight-line direction from an air inlet orifice in an outer wall of the tube body toward an air outlet orifice in an inner wall of the tube body, and an extending direction of each of the air filling through holes of the plurality of air filling through holes deviates toward the gas outlet in the gas inlet and the gas outlet, wherein the inner wall of the tube body at the gas inlet has a frustum-shaped flow-guiding face between the gas inlet and the air outlet orifice of each of the plurality of air filling through holes, wherein the frustum-shaped flow-guiding face gradually decreases from the gas inlet to a portion of the inner wall of the tube body, and wherein the portion of the inner wall of the tube body is upstream of the air outlet orifice of each of the plurality of air filling through holes, such that the gas flow that flows in from the gas inlet flows through the frustum-shaped flow-guiding face, through the portion of the inner wall of the tube body having the air outlet orifice of each of the plurality of air filling through holes, and through the air outlet orifice.

8. The gas cooktop of claim 7, wherein a spacing between the nozzle and the gas inlet of the ejector tube is set to be adjustable.

9. The gas cooktop of claim 7, wherein as the gas flow from the nozzle to the gas inlet the plurality of air filling through holes are configured to mix the primary air to the gas flow such that the gas flow is caused by the primary air to rotate.

10. The gas cooktop of claim 7, wherein the extending directions of the plurality of air filling through holes all deviate from a centerline X of the tube body.

11. The gas cooktop of claim 10, wherein air inlet orifices of the plurality of air filling through holes are sequentially arranged evenly spaced along a circumferential direction of the outer wall of the tube body, and wherein air outlet orifices of the plurality of air filling through holes are sequentially arranged evenly spaced along a circumferential direction of the inner wall of the tube body.

12. The gas cooktop of claim 7, wherein a distance between the air inlet orifice and the gas inlet is less than one third of a length of the tube body.

13. The gas cooktop of claim 7, wherein the plurality of air filling through holes includes two to ten air filling through holes which are arranged evenly spaced around the tube body.

14. The ejector tube of claim 3, wherein a deviation angle $\alpha$ of the extending directions of the plurality of air filling through holes relative to the centerline X of the tube body is 45 degrees.

15. The ejector tube of claim 3, wherein a deviation angle $\alpha$ of the extending directions of the plurality of air filling through holes relative to the centerline X of the tube body is equal to or greater than 20 degrees and less than or equal to 80 degrees.

16. The ejector tube of claim 1, wherein a deviation angle $\beta$ of the extending direction of the plurality of air filling through holes relative to a radial direction of the tube body is 45 degrees.

17. The ejector tube of claim 1, wherein a deviation angle $\beta$ of the extending direction of the plurality of air filling through holes relative to a radial direction of the tube body is equal to or greater than 20 degrees and less than or equal to 80 degrees.

* * * * *